US005301441A

United States Patent [19]

Kownacki

[11] Patent Number: 5,301,441

[45] Date of Patent: Apr. 12, 1994

[54] PNEUMATIC BOUNCING BOOT

[76] Inventor: Charles D. Kownacki, 3829 McClelland Ave., Erie, Pa. 16506

[21] Appl. No.: 16,039

[22] Filed: Feb. 10, 1993

[51] Int. Cl.[5] ..... A43B 3/10; A43B 13/20; A63B 25/08

[52] U.S. Cl. ..... 36/7.8; 36/116; 36/1; 36/29; 36/109; 482/77

[58] Field of Search ..... 36/1, 7.5, 7.8, 29, 36/89, 109, 113, 115, 116, 117, 118, 132, 136, 97; 482/77, 75, 74

[56] References Cited

U.S. PATENT DOCUMENTS

| | | | |
|---|---|---|---|
| 1,545,437 | 7/1925 | Malone et al. | 36/7.8 |
| 2,756,517 | 7/1956 | Youtz | 36/7.8 |
| 3,423,852 | 1/1969 | Smith | 36/7.5 |
| 3,628,262 | 12/1971 | Stopek | 36/7.5 |
| 3,953,930 | 5/1976 | Ramer | 36/117 |
| 4,525,941 | 7/1985 | Ruth, Jr. | 36/116 |
| 4,893,809 | 1/1990 | Blankenzee | 482/77 |
| 5,068,984 | 12/1991 | Kaufman et al. | 36/117 |
| 5,142,798 | 9/1992 | Kaufman et al. | 36/117 |

*Primary Examiner*—Paul T. Sewell
*Assistant Examiner*—Marie Denise Patterson
*Attorney, Agent, or Firm*—Richard K. Thomson

[57] ABSTRACT

A boot for recreational exercise which is equipped with a pneumatic ball spring. The ball is configured as a first semi-ovoid segment and a second smaller semi-ovoid segment which intersect at a minimum dimension. This minimum dimension receives an inwardly directed ledge which is captured by the fully inflated ball to secure the ball to its retainer. The retainer is in turn, secured to the bottom of the boot platform by adjustable dovetail members to permit the ball to be adjusted under the center of gravity of the wearer. The platform has a clamshell attaching member which secures a portion of the boot's weight to the calf of the wearer. The clamshell mechanism limits rotation about the ankle to ±15° and restricts rotation of the foot about the axis of the leg and foot to reduce the potential of injury to the wearer.

25 Claims, 4 Drawing Sheets

PNEUMATIC BOUNCING BOOT

FIELD OF THE INVENTION

The present invention is directed to the field of toys which provide recreational exercise. More particularly, the present invention is directed to pneumatic bouncing boots which can be used with comparative safety.

BACKGROUND AND SUMMARY OF THE INVENTION

The kid in each of us is intrigued by the possibility of defying gravity, bouncing along like walking on the moon. The possibility of strapping a miniature trampoline to each foot and bounding across the terrain is fascinating. Accordingly, many attempts have been made to realize such a fantasy. Examples of shoe springs employing metal springs include U.S. Pat. Nos. 1,843,493 to Pfeifenbring and 3,377,722 to Downing. Bouncing shoes that employ pneumatic springs include U.S. Pat. Nos. 1,545,437 to Malone et al., 2,756,517 to Youtz, 4,525,941 to Ruth, Jr., and 4,676,009 to Davis et al.

Among the short comings of each of these devices is the risk to life and limb for the participant. Each of these devices effectively hangs a dead-weight load upon the ankle and most of them produce a torsional moment tending to rotate the toe downwardly about the ankle. This greatly increases the risk of stumbling or misstepping producing ankle injuries and/or falls.

The present invention provides a bouncing boot for recreational exercise which significantly reduces the risk of injury. A shoe platform is equipped with a stabilizer in the form of a clamshell mechanism including a first clamshell member engaging and partially surrounding a front-calf portion of a wearer's leg and a second clamshell member engaging and partially surrounding a rear-calf portion of a wearer's leg. The clamshells are each equipped with shoulder protrusions which engage stops on the pivot mounts of the platform. The two clamshell members can pivot to open positions encompassing an angle of at least 90° for ingress and egress of the wearer's foot but, the engagement of the pivot-limiting shoulders with the stops limit the on-foot tilting of the boot to ±15°, slightly less than the tilt angle permitted by the ankle. In addition, the stabilizer restricts twisting of the foot about the axis of the leg and longitudinal twisting of the foot about its own axis. The combination of sharing the weight load of the boot with the calf of the leg and limiting twisting about each of three orthogonal axes, significantly reduces the risk of injury to the wearer.

A second important feature which will reduce the risk of injury relates to the center-or-gravity adjustment capability of the present invention. Not all users will be of the same size nor have the same size foot. By providing the boot attachment with means to adjustably accommodate different size feet and providing the pneumatic ball retainer with the capability to assume a plurality of positions, the position of the pneumatic ball spring may be adjusted to best suit the wearer: a position most directly beneath the wearer's center of gravity.

Another unique feature of the present invention has to do with the manner in which the pneumatic ball is secured to the boot. The ball is configured as a first semi-ovoid segment with a first major and minor axis, a second semi-ovoid segment with a second smaller major and minor axis, and a minimum major and minor axis at the intersection of the two segments. This minimum dimension receives an inwardly directed ledge of a receptacle of the ball retainer. The receptacle is secured to the shoe platform using sliding dovetail slots. This sliding capability affords the multiple position adjustability previously referred to. When in use, a force applied to the bottom portion of the first semi-ovoid segment will cause inflating fluid to migrate into the second semi-ovoid segment causing it to expand, further reducing the likelihood of undesired withdrawal of the pneumatic ball from its retainer.

Various other features, advantages and characteristics of the present invention will become apparent after a reading of the following detailed description.

DETAILED DESCRIPTION OF THE INVENTION

Figure 1:
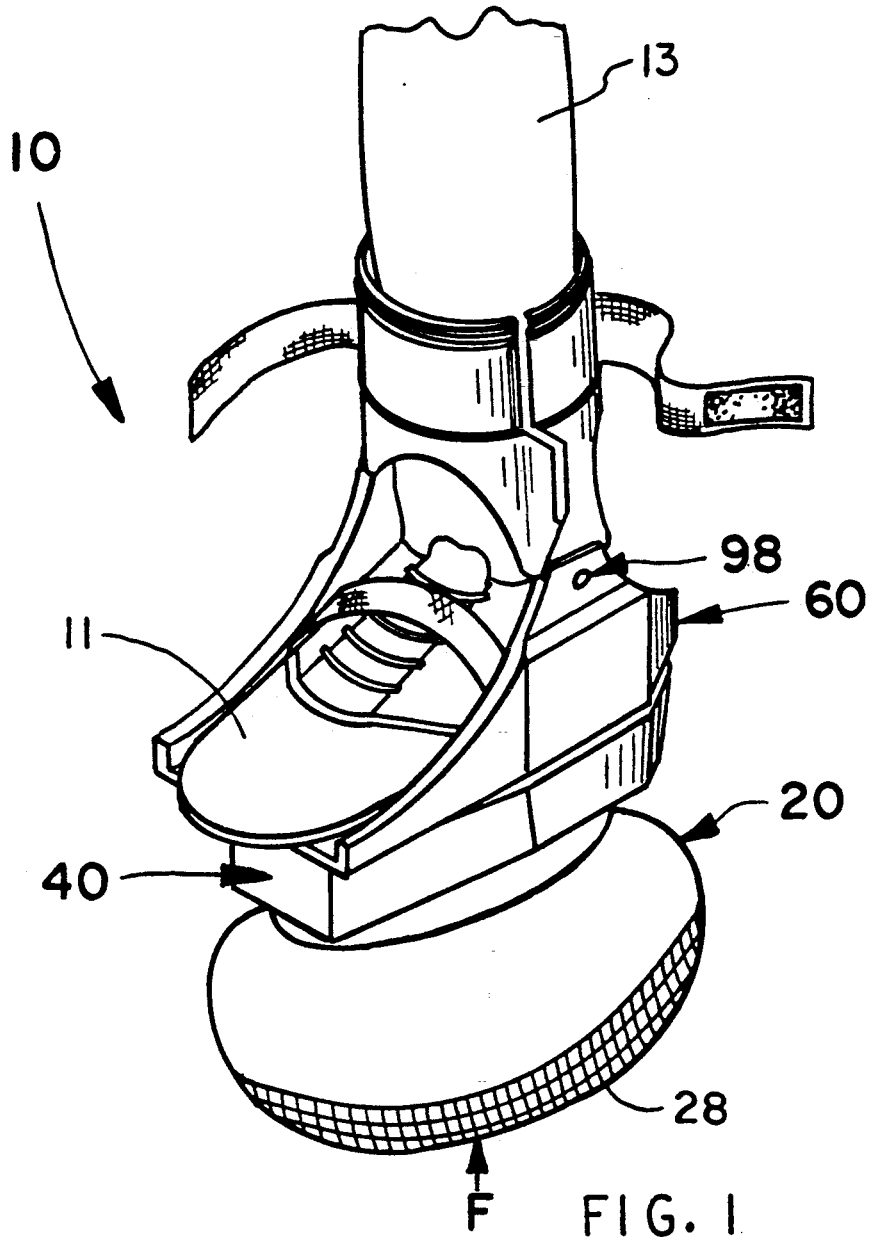
FIG. 1 is a perspective view of one embodiment of the pneumatic bouncing boot of the present invention shown attached to the shod foot of a user.

The pneumatic bouncing boot of the present invention is shown in FIG. 1 generally at 10 attached to a wearer's foot 11. The boot is comprised of pneumatic ball 20, ball retainer 40 and platform/attaching means 60.

Figure 2:
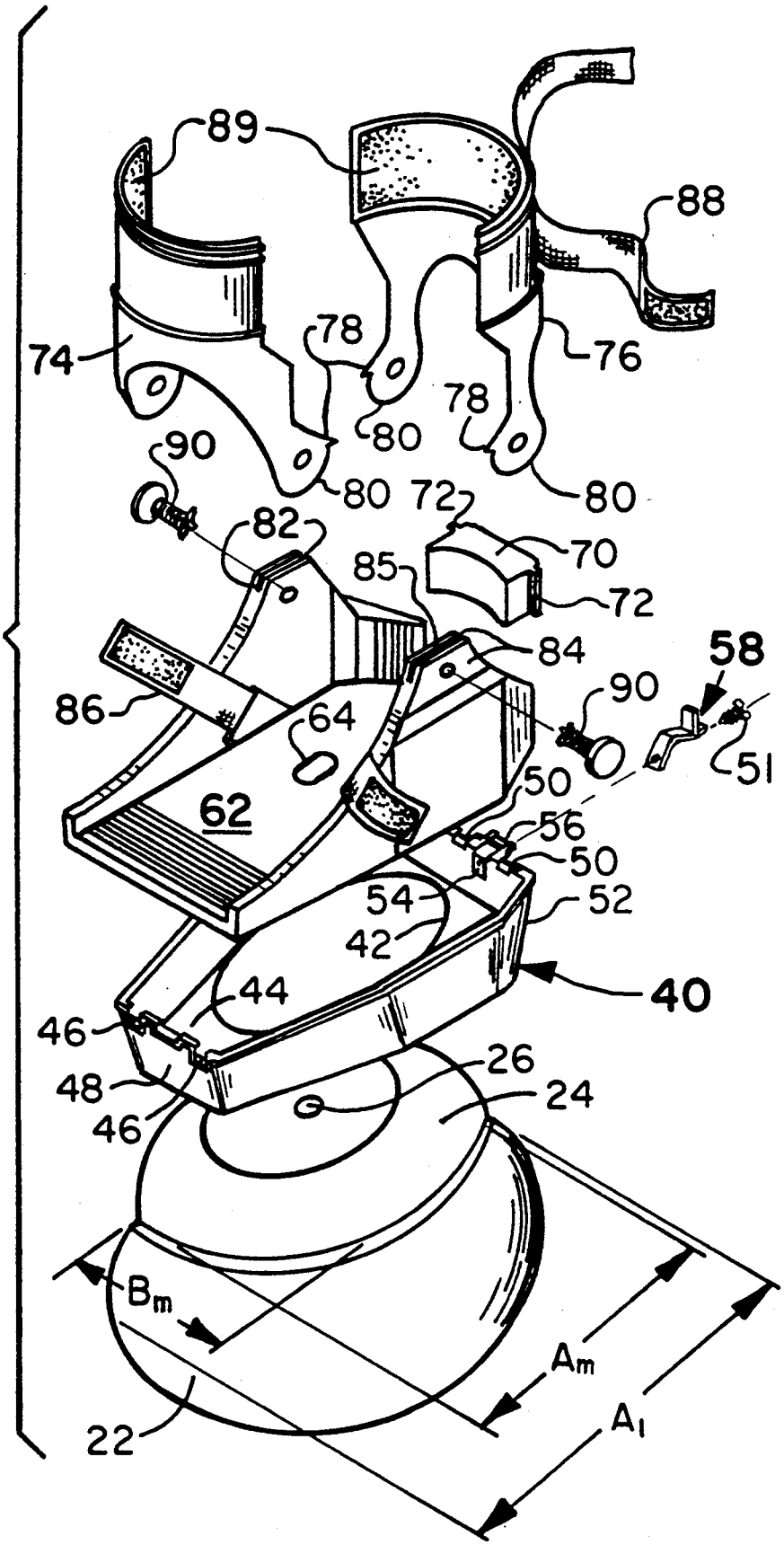
FIG. 2 is an exploded perspective view of the boot shown in FIG. 1.

As best seen in FIGS. 2 and 4–6, ball 20 comprises a first generally semi-ovoid segment 22 having a first major axis $A_1$ and a first minor axis $B_1$ and a second generally semi-ovoid segment 24 having a second major axis $A_2$ and a second minor axis $B_2$. At the intersection of first segment 22 and second segment 24 is a minimum major axis $A_m$ and a minimum minor axis $B_m$ (FIG. 2). The two segments 22 and 24 are pneumatically interlinked and share a common inflating fluid (air). The ball 20 is inflated through fill valve 26. A bottom portion 28 of segment 22 is preferably etched with annon-slip pattern.

Ball retainer 40 has opening 42 through which segment 24 is inserted prior to complete inflation of ball 20. The addition of air through fill valve 26 increases the inflated sizes of both segments 22 and 24. Retainer 40 has an inwardly directed ledge 44 that is received in the minimum circumferential dimension defined by $A_m$ and $B_m$. The inflation of segments 22 and 24 to full size entraps ledge 44 between them and secures ball 20 to retainer 40.

Figure 6:
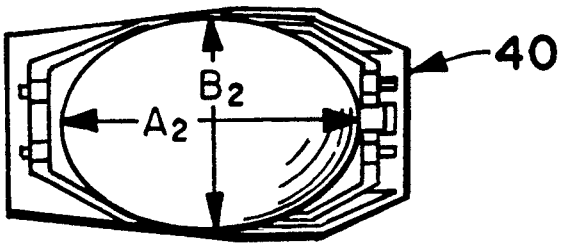
FIG. 6 is a top view of the ball retainer separated from the platform and attaching means.
Figure 10:
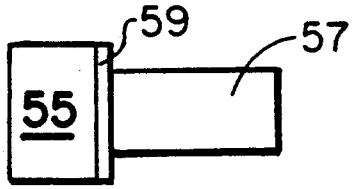
FIG. 10 is a top view of the spring clip used to adjust the position of the ball retainer relative to the platform.
Figure 12:
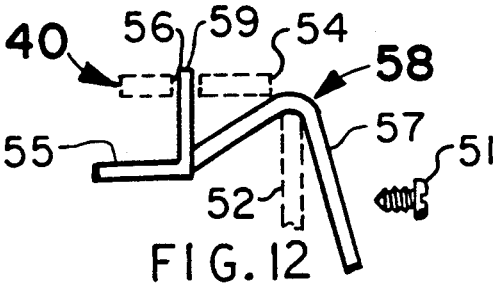
FIG. 12 is a side view of the spring clip shown in FIG. 10.
Figure 13:
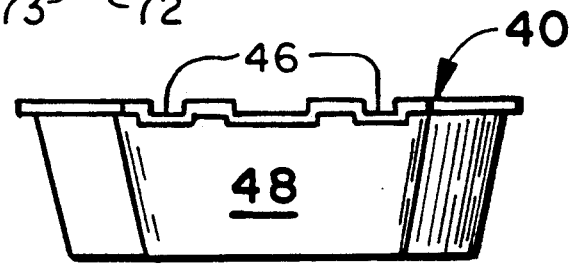
FIG. 13 is an end view of the ball retainer.
Figure 15:
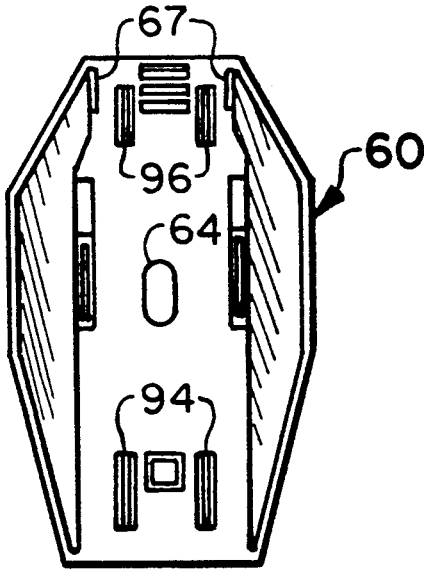
FIG. 15 is a bottom view of that platform.

As best seen in FIGS. 2, 6, and 13, ball retainer 40 is equipped with a first pair of dovetail slots 46 on the front portion 48 and a second pair of dovetail slots 50 on the rear portion 52 of retainer 40. Slots 46 and 50 are the means by which retainer 40 is secured to platform 60 as will be discussed later. Retainer 40 and, hence, ball 20 can be secured in any of three positions along extra-length dovetails 94 and 96 (FIG. 15) by spring clip 58 (FIGS. 2, 10, 12) which has a forward spring finger 57 inserted in opening 54 and a locking finger 59 which extends upwardly through opening 56. Fastener 51 secures finger 57 within retainer 40. From viewing the at rest position of spring finger 57, it will be appreciated that the securing of finger 57 in a vertical position by fastener 51 will exert an upward biasing force upon locking finger 59.

Figure 3:
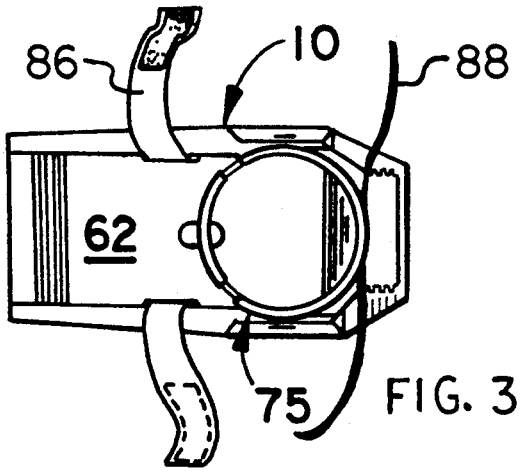
FIG. 3 is a top view of the bouncing boot of the present invention.
Figure 4:
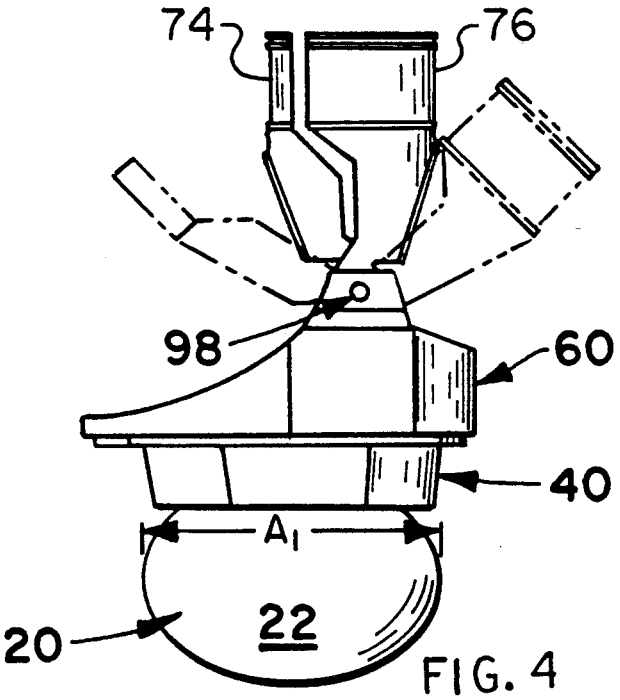
FIG. 4 is a side view of the boot with the open position of the clamshell shown in dotted line.
Figure 5:
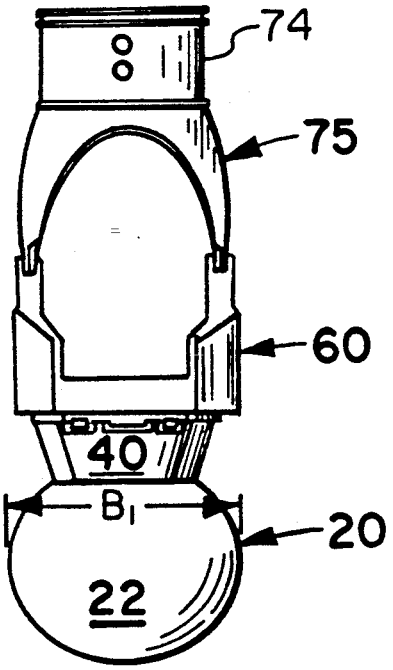
FIG. 5 is a front view of the bouncing boot.
Figure 9:
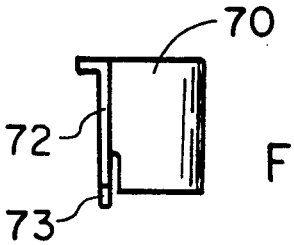
FIG. 9 is a side view of the adjustable heel stop of the present invention.
Figure 11:
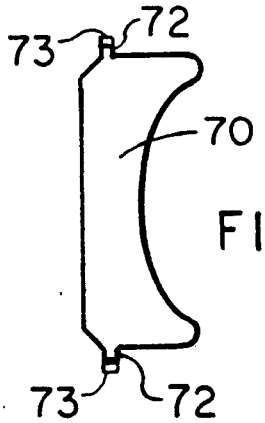
FIG. 11 is a top view of the adjustable heel stop.
Figure 14:
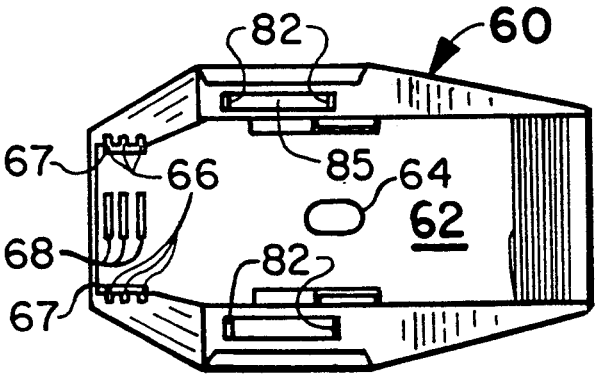
FIG. 14 is a top view of the foot-receiving platform.

As best seen in FIGS. 2, 3 and 14, securing means, or platform 60 includes a planar portion 62 having an opening 64 which permits access to inflation valve 26 when boot 10 is fully assembled. A heel piece 70 (FIGS. 2, 9, 11) having protruding ears 72 can be positioned in any pair of slots 66, three pairs being shown. Ears 73 extending outwardly and downwardly from lower portions of each ear 72 are received in lateral slots 67 to secure heel piece 70 to platform 60 in the desired position. This adjustable heel piece 70 permits the boot 10 to be worn by users who have different size feet, as well as accommodating growth of an individual wearer over the lifetime usage of the apparatus. In keeping with the three pairs of slots 66 to accommodate foot size, three slots 68 are formed in the rear section of planar portion 62. Slots 68 receive locking fingers 59 in one of three positions in order to slide retainer 40 and ball 20 to the position most directly under the center of gravity of the wearer. While this positioning is believed to afford the greatest degree of stability for the user, each individual can adjust the position to his or her liking. To adjust the position of the ball 20 and retainer 40, protruding finger 55 is depressed against the biasing force of spring finger 57 and retainer 40 is moved to position locking finger 59 in the slot 68 affording the position desired.

An important feature of the securing means 60 is clamshell mechanism 75 which includes a first clamshell member 74 which engages and partially surrounds a front calf portion of the wearer's leg, and a second clamshell member 76 which engages and partially surrounds a rear calf portion of the wearer's leg. As can be seen from FIG. 4, clamshell members 74 and 76 can rotate apart an angular minimum of 90° and, more preferably, at least about 105°, to permit the wearer to insert and withdraw their foot. However, a shoulder 78 formed on the hinge portion 80 of each clamshell member 74, 76 engages a stop 82 formed on each of the upstanding portions 84 of platform 60. The engagement of shoulders 78 and stops 82 restrict forward and aft tilting motion about an axis parallel to the user's ankle to ±15°. While this angular freedom is slightly less than the ankle normally will permit, this angular limit stop protects the ankle from possible injury.

A first pair of VELCRO fastener-equipped straps 86 are secured through slots in platform 60 and adapted to secure platform 60 to a toe portion of the user's foot. A second pair of VELCRO fastener-equipped straps 88 surround clamshell members 74 and 76 and hold them closed. The inner surfaces of members 74 and 76 may be equipped with layers of foam rubber 89 to accommodate variations in calf dimensions. By securing a portion of the weight of boots 10 to the calf 13 of the wearer, several benefits are obtained. First, the boot does not hang on the toe portion of the foot alone, exerting a downward rotational torque or moment on the ankle, as was the case with many of the previous designs. Further, the clamshell mechanism 75 limits rotation of the foot about the axis of the leg, preferring instead to keep the foot at the same reference angle it occupied at the time the clamshell mechanism 75 was clamped to the leg. Lastly, the action of the clamshell 75 in clamping the user's calf further limits rotation of the foot about its own longitudinal axis. This restriction of rotation about three orthogonal axes will greatly reduce the potential for leg and ankle injuries, as well as reducing the risk of misstepping and falling.

Figure 7:
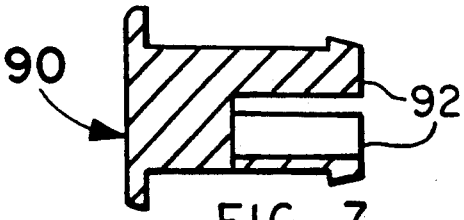
FIG. 7 is a side view in partial section of the snap-in pivot pin.
Figure 8:
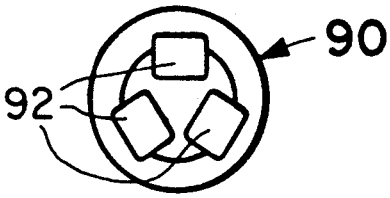
FIG. 8 is an end view of the pivot pin in installed position.

Upstanding portions 84 form a slot 85 which receives the hinge portions 80 of clamshell members 74 and 76. A pair of pivot pins 90 (FIGS. 2, 7 and 8) are each equipped with three flexible fingers 92 which permit them to be snapped into place completing the two hinge assemblies 92.

In operation, heel piece 70 and detent spring clip 58 positioning retainer 40, are adjusted to accommodate the size of the wearer. A boot 10 is then strapped onto each foot 11 using VELCRO fastener-equipped straps 86 and 88. The wearer may then, run, jump, hop or bounce upon pneumatic balls 20. These balls 20 will function as pneumatic springs, storing energy from the force F of each step, making the subsequent step easier as the stored energy is released by re-expanding the first segment 22 as it is successively unweighted.

Various changes, alternatives and modifications will become apparent to a person having ordinary skill in the art following a reading of the foregoing description. It is intended that all such changes, alternatives and modifications as come within the scope of the appended claims be considered part of the present invention.

I claim:

1. A bouncing boot for attachment to a foot of a wearer for recreational exercise, said boot comprising:

a) attaching means for connecting said boot to the foot of said wearer, said attaching means including a platform and means for variably positioning a center of gravity of said wearer relative to said platform;

b) a pneumatic ball providing a lower extremity of said boot and forming a bouncing spring;

c) retaining means for engaging said ball and securing it to a lower portion of said platform, said retaining means including adjusting means to adjust the fore and aft position of said pneumatic ball relative to said platform to maintain said pneumatic ball generally beneath said center of gravity of the wearer.

2. The bouncing boot of claim 1 wherein said attaching means comprises a first clamshell for engaging a front portion of said wearer's leg and a second clamshell for engaging a rear portion of said wearer's leg, said first and second clamshells having a common pivot axis formed by a pivot pin connecting each said clamshell to said platform.

3. The bouncing boot of claim 2 further comprising a strap for encircling and securing said first and second clamshell portions.

4. The bouncing boot of claim 2 further comprising limit stop means on said first and second clamshells for limiting pivotal movement thereof relative to a toe-engaging portion when said first and second clamshells are in engagement with said wearer to ±15° about a pivot axis which is generally parallel to an axis of said wearer's ankle, said limit stop means including first and second shoulders on said first and second clamshells, respectively, and a forward and an aft stop positioned on forward and aft portions of an upright member extending from said platform said forward and aft stops engaging said second and first shoulders, respectively.

5. The bouncing boot of claim 1 wherein said means for variably positioning comprises an adjustable heel stop, a plurality of pairs of aligned slots, said heel stop positionable in any one pair of said plurality of pairs of aligned slots.

6. The bouncing boot of claim 1 wherein said pneumatic ball comprises a first semi-ovoid segment having a first major axis and a first minor axis, a second semi-ovoid segment having a second major axis and a second minor axis shorter than said first major and minor axes, and a minimum major axis and a minimum minor axis formed at a juncture of said two semi-ovoid segments.

7. The bouncing boot of claim 6 wherein said retaining means comprises a receptacle having an inwardly directed ledge, said inwardly directed ledge being received in said minimum major and minor axes of said pneumatic ball to effect retention thereof.

8. The bouncing boot of claim 7 wherein said retaining means further comprises dove tail grooves formed on said receptacle which engage dovetail tracks on said attaching means.

9. The bouncing boot of claim 8 wherein said adjusting means comprises detent means for adjustably securing said dovetail grooves in one of a plurality of positions relative to said dovetail tracks.

10. A pneumatic spring device for attachment to a foot of a wearer for recreational exercise, said device comprising:

a) a pneumatic ball spring member;

b) a shoe platform attached to said pneumatic ball spring member and connectable to a foot of said wearer, said shoe platform including a toe-engaging portion;

c) stabilization means attached to a rear portion of said shoe platform for attachment to the wearer's leg above an ankle region, said stabilization means providing means to restrict i) lateral twisting of the wearer's foot about an axis of said leg;

ii) longitudinal twisting of said wearer's foot about a longitudinal axis of said foot; and, iii) fore and aft pivotal movement of said wearer's foot about an axis generally parallel to an axis of said ankle region.

11. The pneumatic spring device of claim 10 wherein said stabilization means comprises a clamshell mechanism including a first clamshell member engaging and partially surrounding a front-calf portion of said wearer's leg and a second clamshell member engaging and partially surrounding a rear-calf portion of said wearer's leg, said first and second clamshell members having a common pivot axis formed by a pair of pivot pins connecting each said clamshell to said shoe platform.

12. The pneumatic spring device of claim 11 wherein said means for restraining fore and aft pivotal movement of said foot comprises shoulder means formed on each one of said first and second clamshell members and stop means formed on at least one of two lateral, upstanding portions to which said clamshell mechanism is attached engaging said shoulder means.

13. The pneumatic spring device of claim 12 wherein said stop means are formed on both of said two lateral, upstanding portions, a first shoulder and stop means restraining forward pivotal movement of said clamshell mechanism and said second shoulder and stop mechanism restraining rearward pivotal movement of said clamshell mechanism.

14. The pneumatic spring means of claim 13 wherein said pair of pivot pins permit said first and second clamshell members to pivot away from each other an angular amount of at least 90° to permit ingress and egress of said wearer's foot, yet, when said clamshell members are in engaged position, said shoulder and stop means limit the pivotal movement of said clamshell mechanism about an axis generally parallel to said wearer's ankle to ±15°.

15. The pneumatic spring means of claim 10 further comprising means to make adjustment of said shoe platform to accommodate the size of said wearer's foot.

16. The pneumatic spring means of claim 15 wherein said means to make adjustment comprises a heel plate, a plurality of pairs of aligned slots, said heel plate being positionable in one of said pairs of said slots.

17. The pneumatic spring means of claim 16 further comprising means to adjust a position of said ball spring member relative to said shoe platform.

18. The pneumatic spring means of claim 17 wherein said means to adjust comprises dovetail slots on one of a ball retainer and said shoe platform and dovetail tracks on another of said ball retainer and said shoe platform and detent means for adjustably positioning said dovetail slots relative to said dovetail tracks.

19. The pneumatic spring means of claim 10 wherein said pneumatic ball spring member comprises a first generally oval portion having first major and minor axes, a second generally oval portion having second major and minor axes which are shorter than said first axes, and a minimum major axis and a minimum minor axis formed at a junction of said first and second oval portions adapted to receive a minimum dimension of said ball retainer.

20. The pneumatic spring means of claim 19 wherein a lower face of said pneumatic spring ball member is etched to form a non-slip surface.

21. A bouncing boot for attachment to a foot of a wearer for recreational exercise, said boot comprising:

a) attaching means for connecting said boot to the foot of said wearer;

b) a pneumatic ball having a first semi-ovoid segment with a first major axis and a first minor axis providing a lower extremity of said boot and forming a pneumatic spring, a second semi-ovoid segment having a second major axis and a second minor axis shorter than said first major and minor axes, and a minimum major axis and a minimum minor axis formed at a juncture of said two semi-ovoid segments;

c) retaining means for securing said pneumatic ball to said bouncing boot, said retaining means including a platform having an inwardly directed ledge surrounding an opening in said retaining means, said opening receiving said second semi-ovoid segment therethrough and said inwardly directed ledge being generally oval and received in said minimum major and minor axes;

whereby when said pneumatic ball is inflated, said inwardly directed ledge is retained in said minimum major and minor axes by said first and second semi-ovoid segments.

22. The bouncing boot of claim 21 wherein said first and second semi-ovoid segments are pneumatically interconnected and share a common inflating fluid whereby when a force is directed against a bottom portion of said first semi-ovoid segment, said inflating fluid migrates into said second semi-ovoid segment causing it to expand further resisting withdrawal of said pneumatic ball from said retaining means.

23. The bouncing boot of claim 22 wherein said attachment means comprises a clamshell mechanism including a first clamshell member engaging and partially surrounding a front-calf portion of said wearer's leg and a second clamshell member engaging and partially surrounding a rear-calf portion of said wearer's leg.

24. The bouncing boot of claim 23 further comprising means for restraining fore and aft pivotal movement of said foot including shoulder means formed on at least one of said first and second clamshell members and stop means formed on at least one of two lateral, upstanding portions to which said clamshell mechanism is attached, said stop means engaging said shoulder means.

25. The bouncing boot of claim 24 further comprising pivot means permitting said first and second clamshell members to pivot away from each other an angular amount of at least 90° to permit ingress and egress of said wearer's foot, yet, when said clamshell members are in engaged position, said shoulder and stop means limit the pivotal movement of said clamshell mechanism about an axis generally parallel to said wearer's ankle to ±15°.

* * * * *